United States Patent [19]

West et al.

[11] Patent Number: 4,799,320

[45] Date of Patent: Jan. 24, 1989

[54] APPARATUS FOR DIGGING SURFACE TRENCHES IN THE GROUND

[76] Inventors: Raymond M. West, 2807 NE. Brazee, Portland, Oreg. 97212; Robert W. Steele, 1185 Hamilton Heights, Corvallis, Mont. 59828

[21] Appl. No.: 161,403

[22] Filed: Feb. 23, 1988

Related U.S. Application Data

[63] Continuation of Ser. No. 001,914, Jan. 9, 1987, abandoned.

[51] Int. Cl.[4] ..... E02F 5/02

[52] U.S. Cl. ..... 37/80 R; 37/DIG. 6

[58] Field of Search ..... 37/80 R, 83–85, 37/87, 142.5, DIG. 6; 144/208 H, 208 J; 74/608, 609; 83/440.2

[56] References Cited

U.S. PATENT DOCUMENTS 2,821,216 1/1958 West et al. ..... 144/1 R 4,506,444 3/1985 Sundstrom ..... 144/208 J 4,553,950 11/1985 Teich ..... 74/609

FOREIGN PATENT DOCUMENTS 2039337 8/1980 Fed. Rep. of Germany ..... 74/609

*Primary Examiner*—Edgar S. Burr

*Assistant Examiner*—Huong Q. Pham

*Attorney, Agent, or Firm*—Eugene M. Eckelman

[57] ABSTRACT

An elongated rigid bar is arranged to be secured at one of its ends to a power unit and is enclosed through most of its length in a rigid housing. Longitudinal passageways are provided interiorly of the housing for receiving a cross link drive chain trained over a sprocket on the power unit and on a cross shaft supported at a free end of the housing. The cross shaft supports digging units. A ground engaging support wheel is attached to the housing adjacent its free end. The housing has a semi-flexible guard mounted on it adjacent the digging units.

1 Claim, 2 Drawing Sheets

10
12
12
20
16
26
24
60
68
64
70
70
72
38
52
36
66
70
68
12
10
12
50
14
16
22
20
26
3
3
24
4
26
62
60
70
68
56
54
36
42
38
4

APPARATUS FOR DIGGING SURFACE TRENCHES IN THE GROUND

This application is a continuation of application Ser. No. 001,914, filed Jan. 9, 1987, now abandoned.

BACKGROUND OF THE INVENTION

This invention relates to new and useful ground digging apparatuses and in particular relates to improvements in apparatuses arranged for digging surface trenches in the ground such as for making forest fire line trenches and trails.

Devices have heretofore been provided for digging various types of trenches and for different purposes. One such device is shown in U.S. Pat. No. 2,821,216 of which the present applicant is the patentee. Such device comprised a digging apparatus adapted for attachment to a conventional chain saw and utilizing the saw bar and saw chain to drive digging means on the outer end of the bar.

SUMMARY OF THE INVENTION

According to the present invention and forming a primary objective thereof, an improved apparatus is provided for digging surface trenches in the ground, comprising apparatus that is more rugged, dependable, and safe than prior devices.

A more particular object of the invention comprises an apparatus of the type described utilizing a novel bar and housing arrangement for supporting a digging head, such bar being capable of attachment to a conventional saw chain power unit or to a power unit designed for use therewith.

Another object of the invention is to provide a novel guard at the digging head and one which while providing protection to the operator from flying objects nevertheless allows larger type objects to pass through without stalling the power unit.

In carrying out the objectives of the invention, a power unit has an elongated rigid bar secured thereto with an elongated housing secured to the bar and enclosing it. Bearing means are secured to the outer end of the housing and extend laterally for receiving a cross shaft which has a sprocket wheel thereon and attachment means for digging units. The shaft also carries a sprocket wheel which is associated with a sprocket wheel on the output shaft of the power unit by a cross link chain trained around these sprocket wheels and traveling through upper and lower longitudinal passageways between the bar and the housing. The outer end of the housing has a rigid arm secured thereto on which a ground engaging wheel is mounted for supporting the housing at an incline so that the digging unit will contact the ground. The support bar of the device is structured so that it can be connected to a conventional portable chain saw power unit in place of the usual saw bar.

The invention will be better understood and additional objects and advantages will become apparent from the following description taken in connection with the accompanying drawings.

DETAILED DESCRIPTION OF PREFERRED EMBODIMENTS

Figures 1, 2:
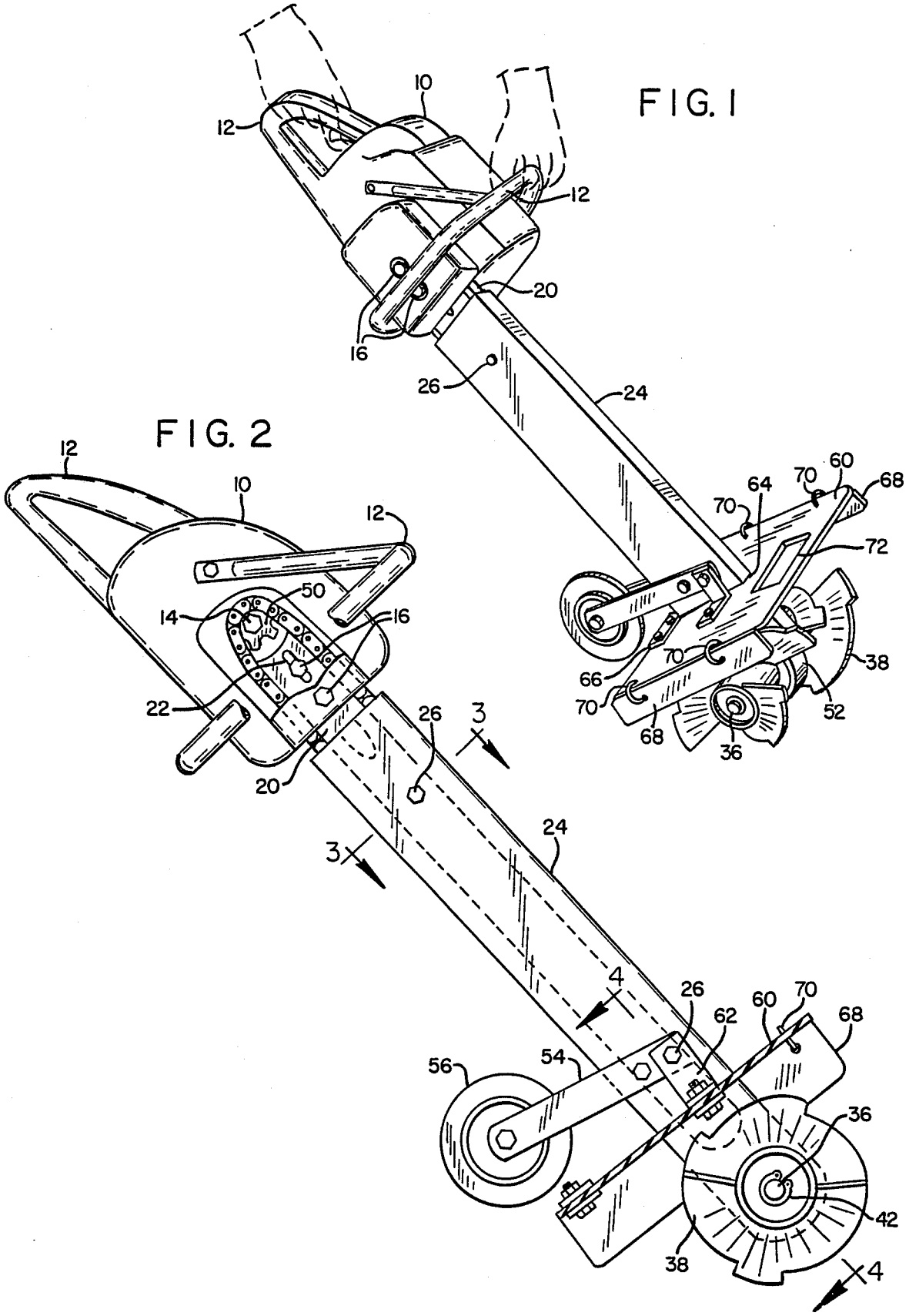
FIG. 1 is a perspective view of the present apparatus for digging surface trenches in the ground.
FIG. 2 is a side elevational view of the apparatus, a portion of the apparatus being broken away to show internal structure.

With particular reference to the drawings, the present apparatus is driven by a power unit 10 having one or more handles 12 for support by the operator. With reference to FIG. 2, such power unit has a laterally extending output shaft 14 and a pair of mounting bolts 16. The power unit 10 may comprise a conventional chain saw power unit which for purposes of the present invention, the saw bar of the chain saw is removed and apparatus of the invention substituted therefor. The power unit 10, however, can comprise any type of power unit designed for the present purpose.

Figure 3:
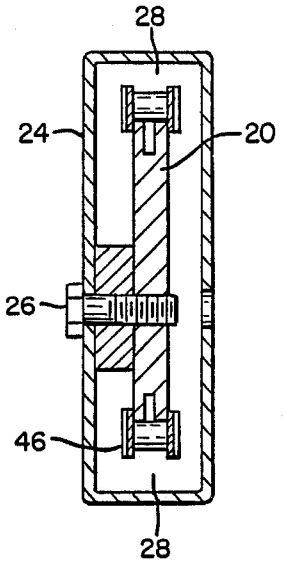
FIG. 3 is an enlarged sectional view taken on the line 3—3 of FIG. 2.
Figure 4:
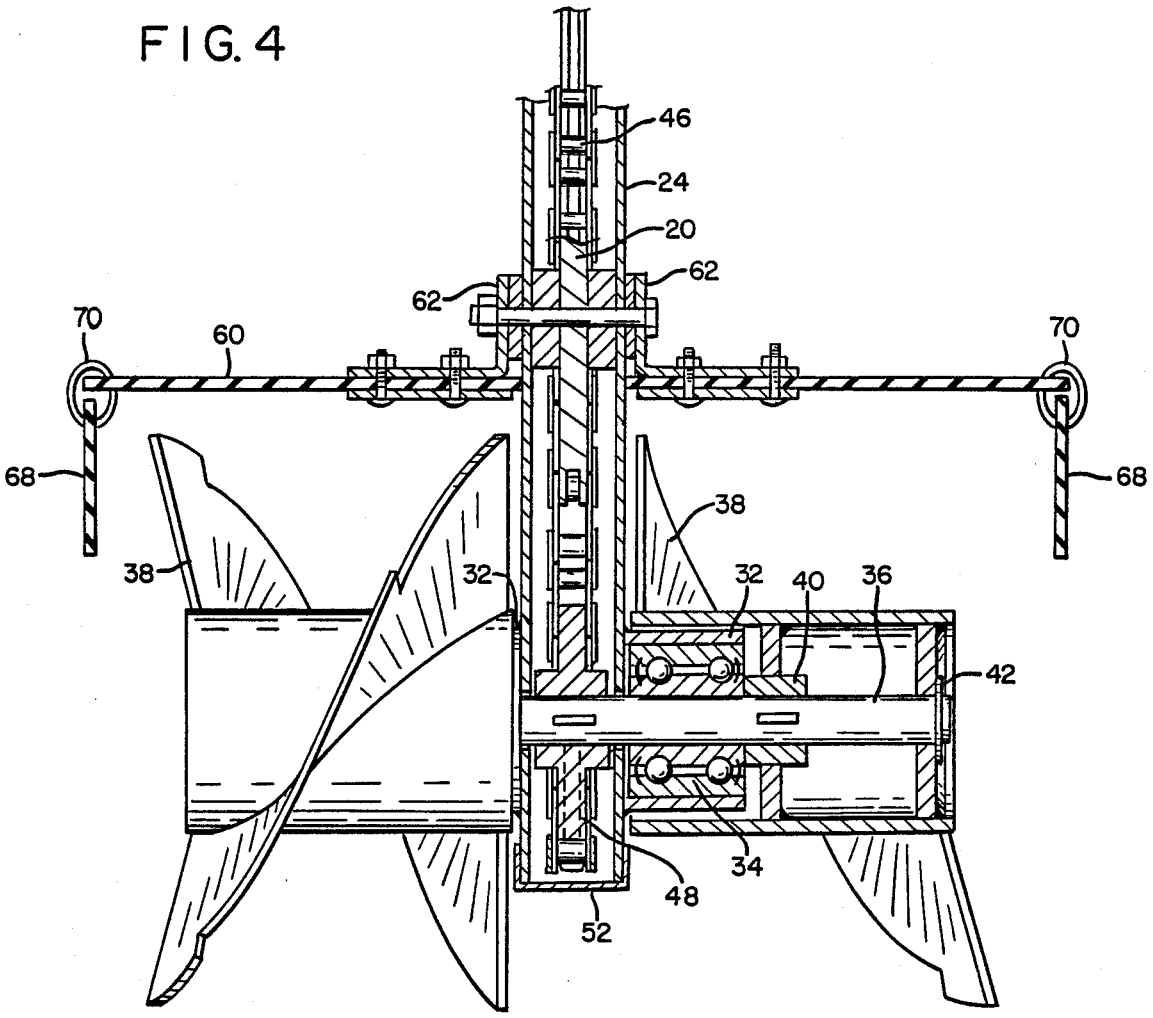
FIG. 4 is an enlarged fragmentary sectional view taken on the line 4—4 of FIG. 2.

Apparatus of the invention comprises a rigid elongated bar 20, such as a saw bar having a pair of slot-type apertures 22 adjacent one end, one of which apertures is shown in FIG. 2, for receiving the bolts 16 and bolting the bar in sturdy, integral projecting connection to the power unit. The bar 20 has a rigid housing 24 secured thereto, as by bolts 26, and with particular reference to FIG. 3, housing 24 has fully enclosed walls around the top, bottom and sides. The interior of the housing is enlarged in cross section relative to the bar to provide upper and lower longitudinal passageways 28.

Housing 24 at its inner or rearward end terminates short of the power unit, and the outer or forward free end thereof has oppositely extending integral lateral bosses 32 which receive and support bearings 34 in turn providing journaled support for a cross shaft 36. Shaft 36 supports digging units 38 thereon which have central hubs 40 arranged to be keyed to the shaft. Removable lock means 42 at the outer ends of the shaft hold the digging units on the shaft for removable attachment.

Drive for the shaft comprises a heavy duty cross link chain 46, such as a motorcycle type chain, and this chain is trained over a sprocket wheel 48 on the shaft 36 and over a sprocket wheel 50 attached to the output shaft 14 of the power unit. The housing fully encloses the sprocket wheel 48 and chain and has a front access cap 52 removably bolted in place.

A pair of rigid support arms 54, FIGS. 1 and 2, are bolted at their inner ends to the housing 24 adjacent the outer end of the housing and support a ground engaging wheel 56 on their free end. The support arms 54 extend downwardly from the housing 24 at an angle tilted slightly toward the power unit. Wheel 56 provides a ground engaging support wheel for the outer working end of the apparatus when it is in use.

A guard 60 is mounted on the working end of the housing 24 at a short spaced distance from the digging units 38. The guard is mounted in place by right angle brackets 62 secured to the housing 24, as by some of the bolts 26. In a preferred arrangement, the guard 60 comprises heavy duty belting material which while being sufficiently rigid to fully protect the operator from flying objects which may be propelled by the digging units at the same time has sufficient flexibility so that objects caught in the digging units can usually distort the guard and pass between it and the digging units without stalling the power unit. The guard may comprise a single piece of belting provided with an opening 64, FIG. 1, arranged to receive the housing. Also, this guard may be split at the bottom for easy attachment to and detachment from the housing and provided at the bottom with a removable cross connector 66 to reinforce this cut portion of the guard.

The guard preferably has side wings 68 or flaps held in a forwardly extending position by oval shaped clamp rings 70. Guard 60 has an upper aperture 72 providing a hand holding opening for carrying the apparatus.

In the use of the apparatus, the wheel 56 can be utilized to support the apparatus while transporting it. Also, when the apparatus is in operation, the chain 46 will be driven by the motor in a direction so that the upper flight thereof is moving away from the power unit for turning the sprocket wheels and shaft clockwise, FIG. 2.

By positioning the apparatus at an incline, as illustrated in FIGS. 1 and 2, the power unit is utilized for digging the ground to form trenches for any intended purpose, such as for providing fire lines for forest fire control. For best operation, the device is pulled in the opposite direction of its digging movement, namely, by pulling it to the left as viewed in FIG. 1. The particular arrangement of the bar 20 and housing 24 provides a rugged structure which will withstand all ordinary duties that are required. The cross link chain is capable of heavy duty operation and in addition is safe in use since it is confined within the housing 24. The apparatus is readily lifted by the operator by grasping handles 12 and the hand hole 72.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. Apparatus for digging surface trenches in the ground comprising:

a power unit having operating handles and a laterally projecting output shaft, an elongated rigid bar secured to one end to said power unit and having an opposite free forward end, an elongated housing secured to said bar and enclosing and reinforcing said bar forwardly of said power unit to said free end, said housing being enlarged relative to said bar to form upper and lower longitudinal passageways therebetween and having a length so as to extend beyond the free end of said bar, a sprocket wheel secured to said output shaft, bearing means secured to the extended end of said housing and projecting laterally outwardly from said housing in spaced relation from the free end of said bar and supported fully by said housing.

a cross shaft journaled in said bearing means for support independently of said bar, a sprocket wheel fixed to said shaft substantially in alignment with the bar and beyond the end of said bar, a cross link motorcycle-type chain trained around said sprocket wheel and traveling longitudinally through said passageways, digging means on said shaft for digging trenches when the power unit is operated, a rigid arm having an inner end secured to said housing adjacent the other end of said housing, a ground engaging wheel secured to said arm for engaging the ground for supporting the housing at an incline so that said digging means contact the ground when revolved, an upright flexible guard secured to said housing adjacent said digging means between said digging means and said power unit to protect the operator from debris thrown by said digging means, said guard being of a flexibility whereby to be self-sustaining and operative to protect the operator but at the same time to allow larger size debris portions to distort it and pass thereby, forwardly projecting side flaps on said guard, and a hand engaging aperture in an upper portion of said guard.

* * * * *